United States Patent [19]

Landua et al.

[11] Patent Number: 4,741,380

[45] Date of Patent: May 3, 1988

[54] COMBINED MOLD ASSEMBLY AND INSPECTION DEVICE FOR CORE AND SHELL SHOOTERS

[75] Inventors: Werner Landua; Reiner Rommel, both of Mannheim, Fed. Rep. of Germany

[73] Assignee: Adolf Hottinger Maschinenbau GmbH

[21] Appl. No.: 27,095

[22] Filed: Mar. 13, 1987

Related U.S. Application Data

[63] Continuation of Ser. No. 784,803, Oct. 4, 1985, abandoned.

[30] Foreign Application Priority Data

Dec. 5, 1984 [DE] Fed. Rep. of Germany ..... 3444343

[51] Int. Cl.[4] ..... B22C 9/10

[52] U.S. Cl. ..... 164/341; 164/228; 164/233; 164/342

[58] Field of Search ..... 164/137, 228, 229, 230, 164/231, 232, 233, 234, 339, 341, 342, 343, 344, 412

[56] References Cited

U.S. PATENT DOCUMENTS 3,528,481 9/1970 Lund ..... 164/234
4,417,616 11/1983 Seitz ..... 164/137

FOREIGN PATENT DOCUMENTS 2937414 1/1981 Fed. Rep. of Germany ..... 164/228
3148461 4/1983 Fed. Rep. of Germany .

*Primary Examiner*—Nicholas P. Godici
*Assistant Examiner*—Richard K. Seidel
*Attorney, Agent, or Firm*—Toren, McGeady & Associates

[57] ABSTRACT

The invention relates to a combined tooling assembly and inspection device having a tooling support with a double tooling mounting, which can be turned about a horizontal axis, for attaching to core and shell shooters and includes a base frame, equipped with a movable slide, a hinged table with a cylinder and gripping device, and a tooling mounting with a gripping device and arm grippers for fastening the fixed tooling half and the movable tooling half. The device according to the invention is used for positioning heavy toolings for fixing to the tooling support, by which means the time-consuming, manual interchanging of the toolings is abolished.

1 Claim, 2 Drawing Sheets

COMBINED MOLD ASSEMBLY AND INSPECTION DEVICE FOR CORE AND SHELL SHOOTERS

Figure 1:
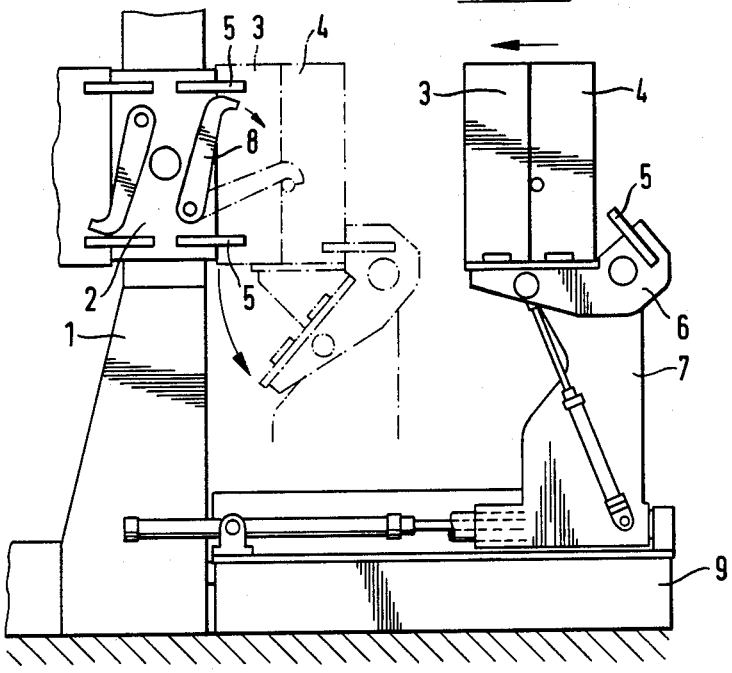

This is a continuation of application Ser. No. 784,803, filed Oct. 4, 1985, now abandoned.

The invention relates to a combined mold assembly according to the preamble of the patent claim.

A core and shell shooter having a machine stand, a mold support, a shooting device and a withdrawal device, is known from German Patent Specification No. 3,148,461, wherein the mold support is equipped with a double mold mounting, which can turn about a horizontal axis, and with a shooting device which interacts with the mold mounting and which consists of two shooting shells connected to one another and is pivotably mounted about a vertical axis.

This known machine has the disadvantage that the mold to be changed has to be brought up to the mounting surface by means of a crane and the connection has to be made manually by bolting the two parts. This measure is time-consuming and requires the machine to be stopped.

The object of the invention is to create a device by means of which it is possible, in machines of the known type, automatically to bring the mold up to the mounting surface and automatically clamp the same on the machine and to do so when the machine is running.

This object is achieved by the technical teaching described in the defining clause of the patent claim.

By means of the device according to the invention having a movable slide, a hinged table with the mold is brought up to the mold mounting of the machine and clamped. Following this first mold assembly step carried out automatically is the second automatic inspection and cleaning step, by separating the two mold halves, so that inspection and cleaning of the two halves can be carried out. The machine can continue to run during this period. By means of the combined mold assembly and inspection device, it is not only possible for complete molds to be automatically fed to the mold mounting or removed from the latter, but also possible for only one mold half to be withdrawn.

A device according to the invention offers considerable advantages compared with known devices, because the complicated positioning of the heavy molds for fastening to the mold support of the mounting device is dispensed with. For this purpose, the complete mold, consisting of the halves, is placed on a hinged table surface and moved up to the mold support of the mounting by the movable slide.

This device can also be used to open a mold. A considerable time saving for inspection, cleaning and for minor repairs is connected with this, because the mold does not have to be removed from the machine and parted by complicated operations.

For this purpose, the table surface is swung down and a mechanical gripping device swung in in a parallel direction. After the slide has approached the right-hand mold half and after the mechanical gripping device has been activated or reactivated in the mold mounting, a mold half can be removed by the horizontal slide.

The drawing explains an illustrative embodiment of the invention.

Figure 2:
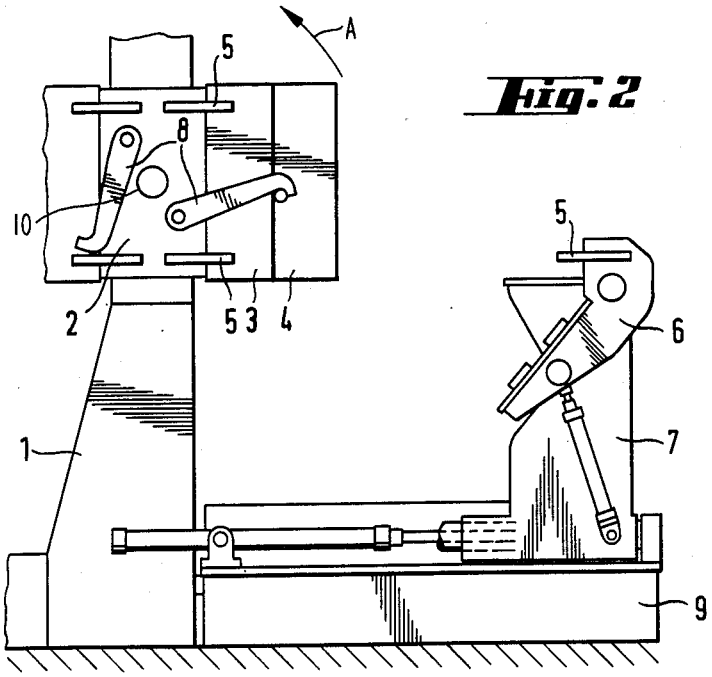

FIG. 1 schematically shows the preparation of the mold before assembly, whereas FIG. 2 shows the mold assembled on the core and shell shooter and the device according to the invention in the neutral position.

Figure 3:
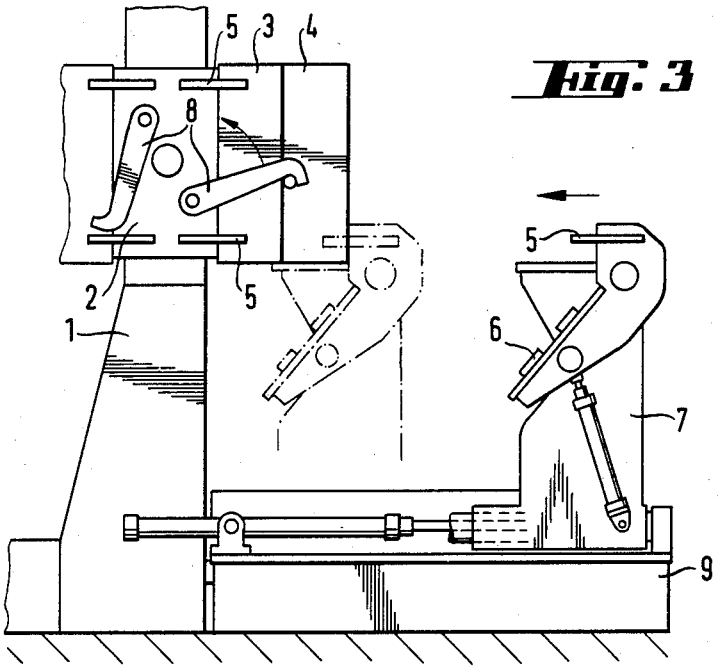
Figure 4:
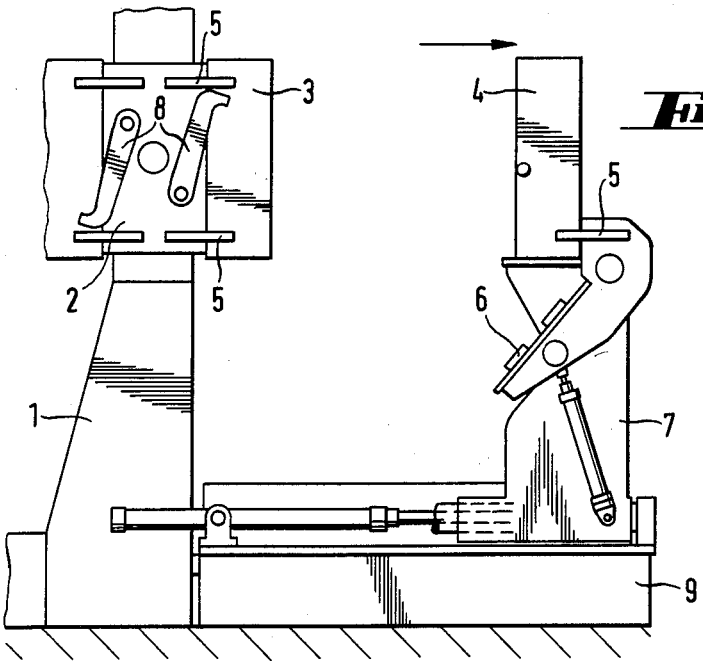

The mold assembled onto the machine can be seen from FIG. 3, one half of which mold, according to FIG. 4 has been gripped and separated by the assembly device.

The reference numeral 1 designates the core and shell shooter according to the German Patent Specification No. 3,148,461. On the base frame 9 of the device is located the slide 7 to be actuated which contains the hinged table 6 with grippers 5, on which table one or both mold halves 3 and 4 can be placed down and fastened. The grippers 5 located on the machine 1 are also used like the grippers on the hinged table 6 for fastening the respective mold halves 3 or 4. The mold halves 3 and 4, which are moved together, are fastened on the mold mounting 2 by means of the pivotable gripper arms. Mold housing 2 is rotable about a horizontal axis 10, as indicated by arrow A in FIG. 2 of the drawing.

We claim:

1. A combined mold assembly and inspection device having a double mold mounting, the mold including first and second mold halves, the mold mounting being rotatable about a horizontal axis, adapted for attaching to core and shell shooters, the device comprising a base frame, a movable and mechanically actuated slide member mounted on the base frame, a hinged table for supporting the first and second mold halves, the table mounted on the slide member mechanically actuated by means of a cylinder, and the table including a first gripping device for gripping the first and second mold halves, and the mold mounting having a second gripping device and arm grippers for fastening the first mold half and the second mold half, respectively.

* * * * *